US005762526A

United States Patent [19]

Kuramoto et al.

[11] Patent Number: 5,762,526

[45] Date of Patent: Jun. 9, 1998

[54] ELECTRICAL TERMINAL CONNECTION FOR A COMPRESSOR

[75] Inventors: Eiji Kuramoto; Masaaki Yamanoi, both of Ota; Eiichi Murata, Isesaki; Kiichi Oyama, Gunma-ken, all of Japan

[73] Assignees: Sanyo Electric Co., Ltd., Osaka; Tomita Electric Co., Ltd., Gunma-ken, both of Japan

[21] Appl. No.: 631,382

[22] Filed: Apr. 12, 1996

[30] Foreign Application Priority Data

Apr. 14, 1995 [JP] Japan ..... 7-113945

[51] Int. Cl.[6] ..... H01R 4/10

[52] U.S. Cl. ..... 439/877; 439/874; 439/884

[58] Field of Search ..... 439/877, 874, 439/884

[56] References Cited

U.S. PATENT DOCUMENTS

| | | | |
|---|---|---|---|
| 2,451,800 | 11/1948 | Buchanan et al. . | |
| 3,665,367 | 5/1972 | Keller et al. | 439/874 |
| 4,109,992 | 8/1978 | Hughes et al. . | |
| 4,394,533 | 7/1983 | Naito | 439/874 |
| 4,884,984 | 12/1989 | Matsumoto | 439/877 |
| 5,181,867 | 1/1993 | Rodondi et al. | 439/854 |
| 5,195,910 | 3/1993 | Enomoto et al. | 439/874 |

FOREIGN PATENT DOCUMENTS

| | | |
|---|---|---|
| 0 054 854 | 6/1982 | European Pat. Off. . |
| 0 279 023 | 8/1988 | European Pat. Off. . |

*Primary Examiner*—Gary F. Paumen
*Attorney, Agent, or Firm*—Darby & Darby

[57] ABSTRACT

An electric compressor has improved ability to connect an end of a stator winding with fastening terminals so that electrical connection can be established between the stator winding and the sealed terminal.

The electric compressor includes lug terminal strips connected electrically to ends of lead wires from the stator winding each covered with an insulating tube, and fastening terminals connected through the lug terminal strips to the sealed terminal for supplying power to the electric elements. The lug terminal strips are manufactured by press molding and each includes a pair of conductor pressing portions, a cylindrical portion formed on one side of the conductor pressing portions, and a pair of insulating film fixing portions formed on the other side of the conductor pressing portions so that the fastening terminal can be connected to the cylindrical portion by pressing the conductor pressing portions onto the stator winding and fixing the insulating film fixing portions to the insulating tube by pressure welding.

4 Claims, 6 Drawing Sheets

ELECTRICAL TERMINAL CONNECTION FOR A COMPRESSOR

BACKGROUND OF THE INVENTION

This invention relates to an electric compressor used for a refrigerating cycle in refrigerators or air conditioners and, more particularly, to a structure of lead wires coupling in a container for the electrical elements a sealed terminal with electric elements themselves.

In this type of conventional electric-compressor, the sealed terminal is used as an input terminal for AC power to be supplied to the electric elements. A stator winding constitutes one of the electric elements which are generally connected by three lead wires.

Such a connecting structure between the electric elements and the sealed terminal is disclosed, for example, in Japanese Utility-Model Publication No. 4-14452 (H02K5/22). In this structure one of the ends of metal cylindrical-members is electrically connected to the ends of the lead wires extending from the stator winding and the other ends of the cylindrical members are connected to fastening terminals (crimp type terminals).

In such a structure, however, the unit price of a cylindrical member is expensive. There is also a limit to the external size of the cylindrical member due to the limited size inside the possible pressure welding area on the fastening terminal, resulting in limitations on the size or number of the stator windings to be fixed by pressure welding.

To solve the above problems, for example, Japanese Utility-Model Publication No. 4-128058 (H02K3/38) teaches a connecting structure in which conductive relay members are each interposed between the fastening terminal and the end of the lead wire so that an electrical connection can be established by inserting a core of the lead wire into a concave portion formed in each of the relay members.

Although the above structure can solve such problems that arise in the structure disclosed in the former publication, the relay members are irregular in size because they are manufactured by drawing, and this makes it difficult to solder the end of the lead wire in the concave portion. Accordingly, another problem arises in that the relay members are unsuitable for automating the joint soldering process.

SUMMARY OF THE INVENTION

It is an object of the present invention to solve the above problems in the art and to provide an electric compressor with improved means for connecting the end of the stator winding with the fastening terminals so that electrical connection can be established between the stator winding and the sealed terminal.

In accomplishing the above object, the present invention provides an electric compressor having electric elements and compressive elements within a single container in which a stator winding constituting part of the electric elements is connected with a sealed terminal fixed to the container. The electric compressor comprises lug terminal strips to be connected electrically to the end of the stator winding and which are covered with an insulating tube. Fastening terminals are connected through the lug terminal strips to the sealed terminal for supplying power to the electric elements. The lug terminal strips are manufactured with press molding, each including a pair of conductor pressing portions, a cylindrical portion formed on one side of the conductor pressing portions, and a pair of insulating film fixing portions formed on the other side of the conductor pressing portions so that the fastening terminal can be connected to the cylindrical portion by pressing the conductor pressing portions onto the stator winding and fixing the insulating film fixing portions to the insulating tube with pressure welding.

In the electric compressor according to the present invention, the lug terminal strips are interposed between the stator winding, which is covered with the insulating tube, and the fastening terminals. The lug terminal strips each include a pair of conductor pressing portions, a cylindrical portion formed on one side of the conductor pressing portions, and a pair of insulating film fixing portions formed on the other side of the conductor pressing portions so that the fastening terminal can be connected to the cylindrical portion by pressing the conductor pressing portions onto the stator winding and fixing the insulating film fixing portions to the insulating tube with pressure welding. Accordingly, the insulating film fixing portions can be fixed to the insulating tube with pressure welding simultaneously with the pressing of the conductor pressing portions onto the stator winding, and this makes it possible to ease the task of providing electrical connection between the end of the stator winding and the lug terminal strips, resulting in a remarkable improvement in the effort necessary to make the connection between the end of stator winding and the fastening terminals.

In particular, the lug terminal strips are manufactured with press molding, and this allows the formation of a series of terminals coupled with a serial terminal joint, thereby automating the connection process with the stator winding and the like.

The assembly of the electric compressor of the present invention further includes the step of injecting melted solder into the cylindrical portion mentioned above.

In such a structure, the conductor pressing portions can be also soldered simultaneously by injecting the solder into the cylindrical portion after pressing the stator winding into the conductor pressing portions. and This makes it possible to remarkably improve the overall ability to connect the end of the stator winding with the lug terminal strips.

Furthermore, the assembly of the electric compressor of the present invention includes the step of forming a slit on the cylindrical portion mentioned above.

In such a structure, the cylindrical portion can be smoothly filled with melted solder, resulting in a further improvement in the ability to make the connection between the end of the stator winding and the lug terminal strips.

BRIEF DESCRIPTION OF THE DRAWINGS

The above and other objects and features of the invention will be apparent to those skilled in the art from the following preferred embodiments thereof when considered in conjunction with the accompanying drawings, in which.

DETAILED DESCRIPTION OF THE PREFERRED EMBODIMENTS

Figure 1:
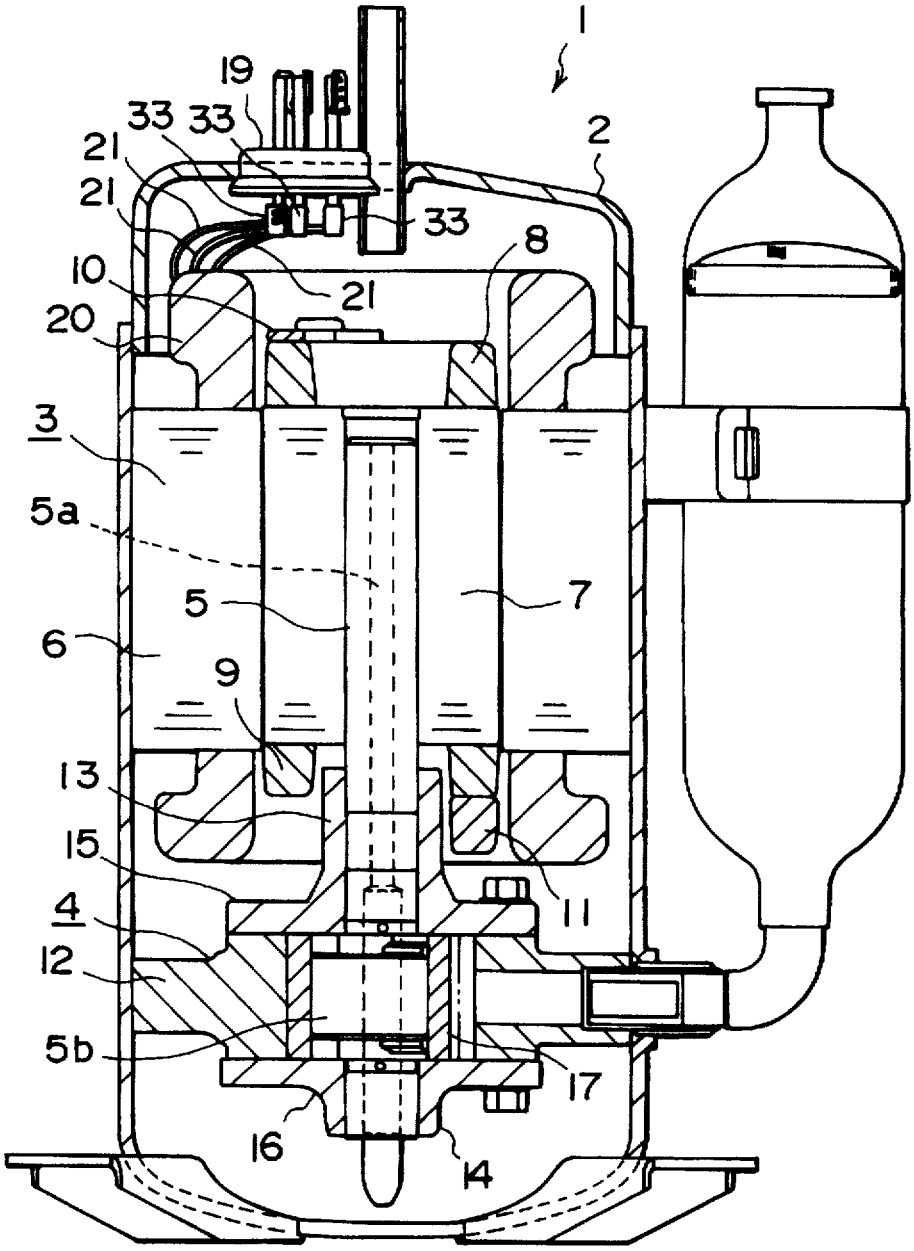
FIG. 1 is a longitudinal sectional and side view of an electric compressor according to the present invention.

Referring now to the drawings, a description will be made in detail with respect to a first embodiment of the present invention.

FIG. 1 is a longitudinal sectional and side view of an electric compressor 1 of the present invention. In FIG. 1, the electric compressor 1 is a sealed type electric compressor used for a refrigerating cycle in refrigerators or air conditioners. The compressor 1 has a single sealed container 2 in which electric elements 3 and compressive elements 4 are provided on the upper side and the lower side, respectively. The electric elements 3 and the compressive elements 4 are coupled by a rotating shaft 5 having a penetrating hole 5*a* provided therethrough in an axial direction.

The electric elements 3 include a stator core 6, a rotor 7, an end ring 8 and a balance weight 10 provided on the rotor 7, and an end ring 9 and a balance weight 11 provided under the rotor 7.

The compressive elements 4 include a cylinder 12 pressed into the sealed container 2 under pressure, an upper frame body 15 and a lower frame body 16 operative to close openings of the cylinder 12, bearing portions 13 and 14 respectively provided on the frame body 15 and under the frame body 16, a roller 17 located externally in an eccentric portion 5*b* of the rotating shaft 5 so as to rotate eccentrically within the cylinder 12, and a vane (not shown) the tip of which is pressed onto the roller 17 at all times so as to divide the inside of the cylinder 12 into a high pressure side and a low pressure side.

A sealed terminal 19 is attached to the inside of the sealed container 2. A stator winding 20 inserted into the stator core 6 is connected to the sealed terminal 19, as described later, through lead wires 21 extending from the end thereof so that electric power can be supplied from the outside of the sealed container 2 to the stator winding 20 through sealed terminal 19 and the lead wires 21.

Figure 3:
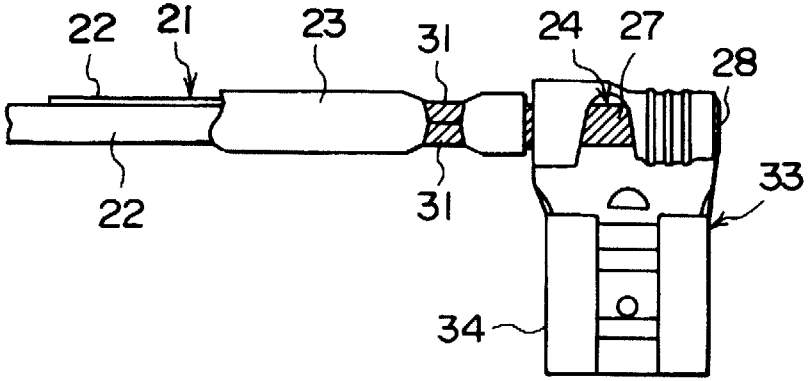
FIG. 3 is an enlarged view of a wiring portion of a stator winding included in the electric compressor according to the present invention.
Figure 2:
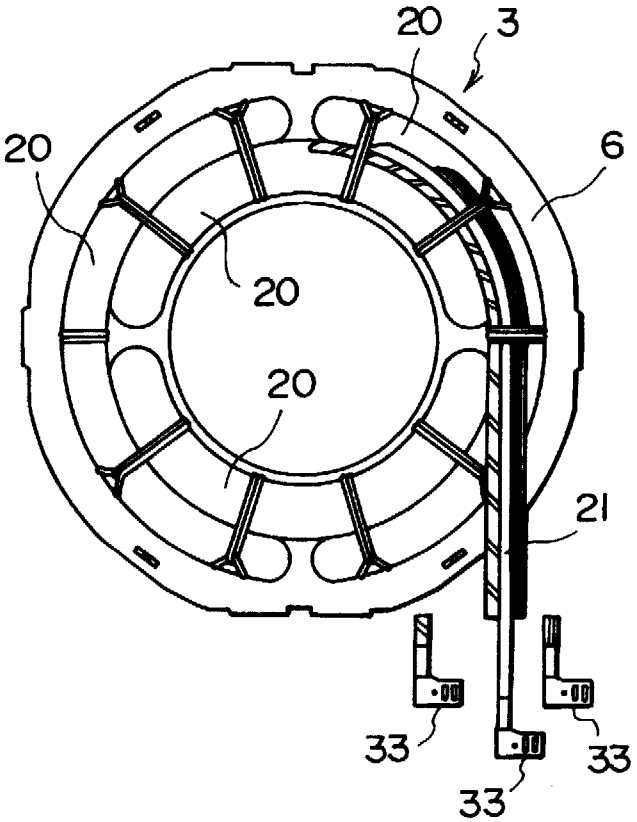
FIG. 2 is a plan view of electric elements included in the electric compressor according to the present invention.

Next, FIG. 2 is a plan view of the electric elements 3 and FIG. 3 is an enlarged view of the lead wires 21 extending from the stator winding 20, where the lead wires 21 are three in number. The stator winding 20 is formed such that an external surface of an unillustrated core is covered with enamel coating 22. The enamel coating 22 is then stripped off at the end of the lead wires 21 by a wire grinding machine or with high frequency heating, making the core bare.

The lead wires 21, which are covered with an insulating tube 23, such as one made of a polyester film or Teflon, are cut off with a prescribed size for the purposes of insulation, protection and reinforcement of the flexural strength of the lead wires 21 against breakage of the stator winding 20.

Figure 4:
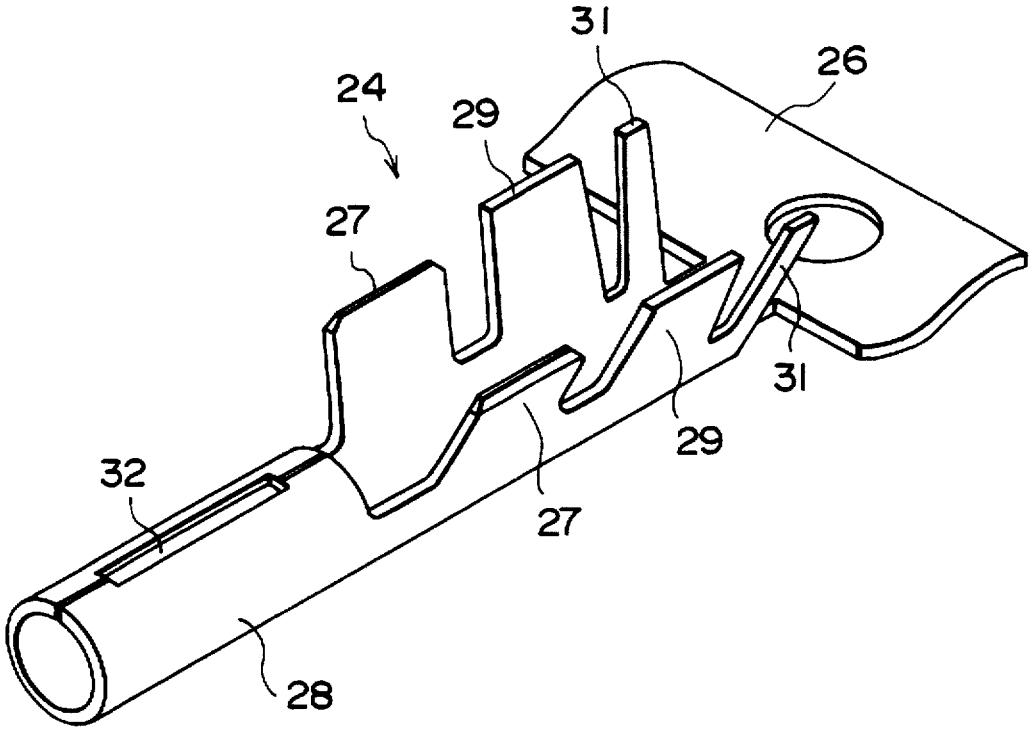
FIG. 4 is a perspective view of a lug terminal strip.

Indicated by reference numeral 24 is a lug terminal strip molded by pressing a metal plate, such as one made of brass, phosphor bronze, aluminum or other materials having conductivity corresponding to the above metals. A plurality of lug terminal strips 24 are formed together as a series of terminal strips coupled to a serial terminal joint 26 as shown in FIG. 4. Each of the lug terminal strips 24 includes a pair of conductor pressing portions 27—27 projecting in the central portion, a cylindrical portion 28 formed into a roll shape on one side of the conductor pressing portions 27—27, a pair of conductor soldering portions 29—29 projecting on the other side of the conductor pressing portions 27—27, and a pair of insulating film fixing portions 31—31 projecting on the other side of the conductor soldering portions 29—29.

The conductor pressing portions 27—27, the conductor soldering portions 29—29, and the insulating film fixing portions 31—31 project so that opposite sides can together form a V-like shape. On the other hand, the cylindrical portion 28 is formed into a bored roll with a slit 32 in a butted line.

Indicated by reference numeral 33 in FIG. 3 is a fastening terminal (flag-shaped terminal) one end of which forms a flag-shaped portion 34 which is to be fitted into the sealed terminal 19.

In connecting the lead wire 21, the lug terminal strip 24 and the fastening terminal 33 with each other, the lead wire 21 is first inserted into the lug terminal strip 24 from the side of having the insulating film fixing portions 31—31 of the lug terminal strip 24 while a plurality of the lug terminal strips 24 are arranged as a series of terminals on a serial terminal joint 26 as shown in FIG. 4. The core of the lead wire 21 then reaches the conductor pressing portions 27—27 and the conductor soldering portions 29—29, while the end of the insulating tube 23 is positioned in a line between the insulating film fixing positions 31—31.

Next, the conductor pressing portions 27—27, the conductor soldering portions 29—29, and the insulating film fixing portions 3131 are simultaneously pressed toward each other such that the conductor pressing portions 27—27 and the conductor soldering portions 29—29 are temporary pressed onto the core of the read wire 21, and the insulating film fixing portions 31—31 are pressed onto the insulating tube 23 by pressure welding. In this condition, the lug terminal strip 24 is separated from the serial terminal joint 26 to form a single unit.

The cylindrical portion 28 formed at the end of the lug terminal unit is then immersed in a solder bath in order to inject the melted solder thereinto, while soldering the conductor pressing portions 27—27 and the conductor soldering portions 29—29 at the same time, thus assuring sufficient area and strength for the pressing portions of the lug terminal strip 24. In this case, a slit 32 is formed on the cylindrical portion 28 so that the cylindrical portion 28 can be smoothly filled with the melted solder.

Finally, the fastening terminal 33 is pressed onto the cylindrical portion 28.

As discussed above, the present invention allows soldering of the conductor pressing portions 27—27 and the conductor soldering portions 29—29 at the same time by injecting the melted solder into the cylindrical portion 28 after fixing the lead wire of the stator winding 20 to the conductor pressing portions 27—27 with pressure welding. The present invention also allows fixing of the insulating film fixing portions 31—31 to the insulating tube 23 with pressure welding simultaneously when pressing the conductor pressing portions 27—27 onto the core of the wire 21. Accordingly, the effort in making a connection between the lead wires 21 and the lug terminal strips 24 can be remarkably improved on the whole.

In particular, the lug terminal strips 24 are molded as a series of terminals coupled with the serial terminal joint 26 by pressing a metal plate as mentioned above, and this allows automation of the connection process with the stator winding and the like.

Figure 5:
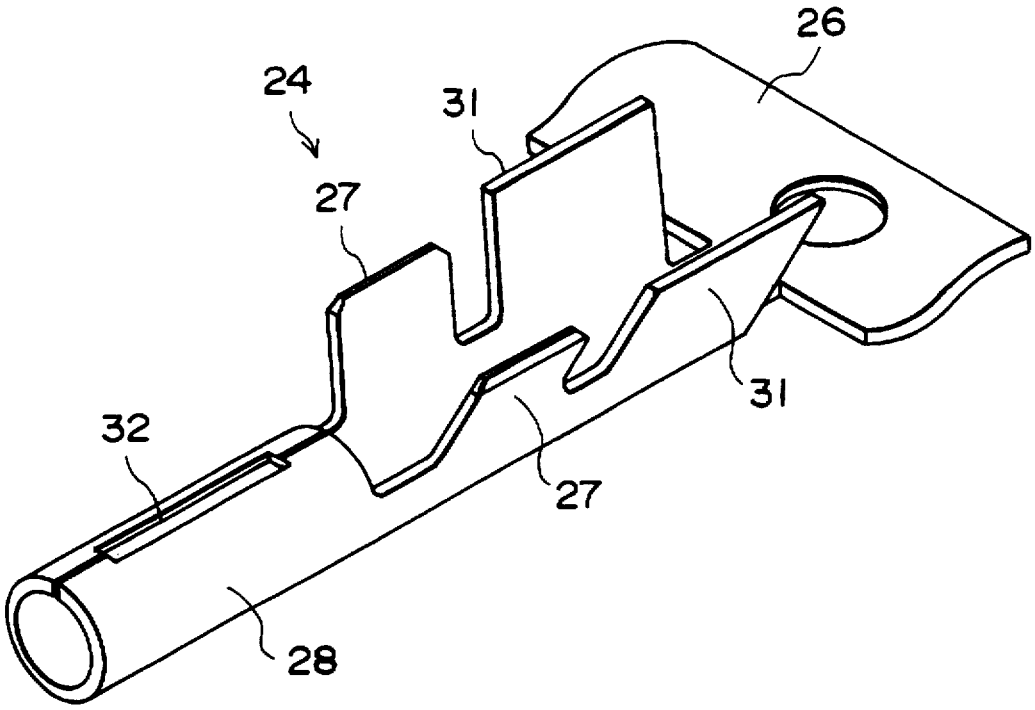
FIG. 5 is a perspective view of another lug terminal strip.

Next, FIG. 5 shows another embodiment of lug terminal strip 24. In this case, the conductor soldering portions 29—29 of FIG. 4 are eliminated and the insulating film fixing portions 31—31 are widened on the other side of the conductor pressing portions 27—27.

Figure 6:
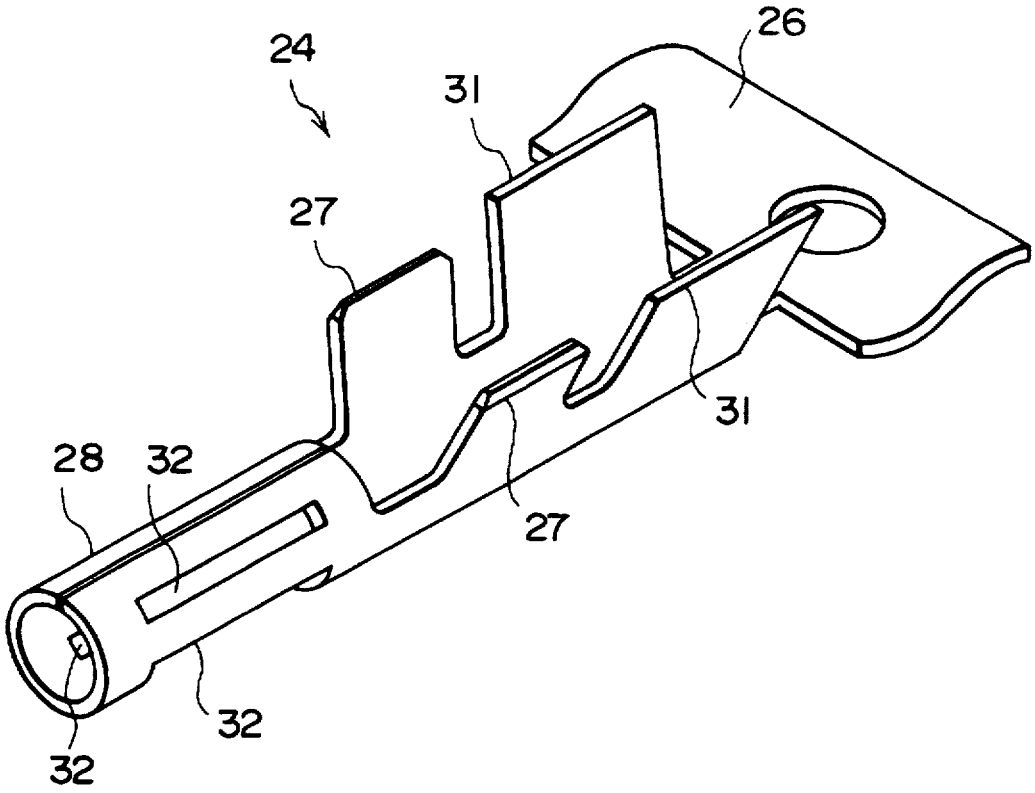
FIG. 6 is a perspective view of still another lug terminal strip.
Figure 7:
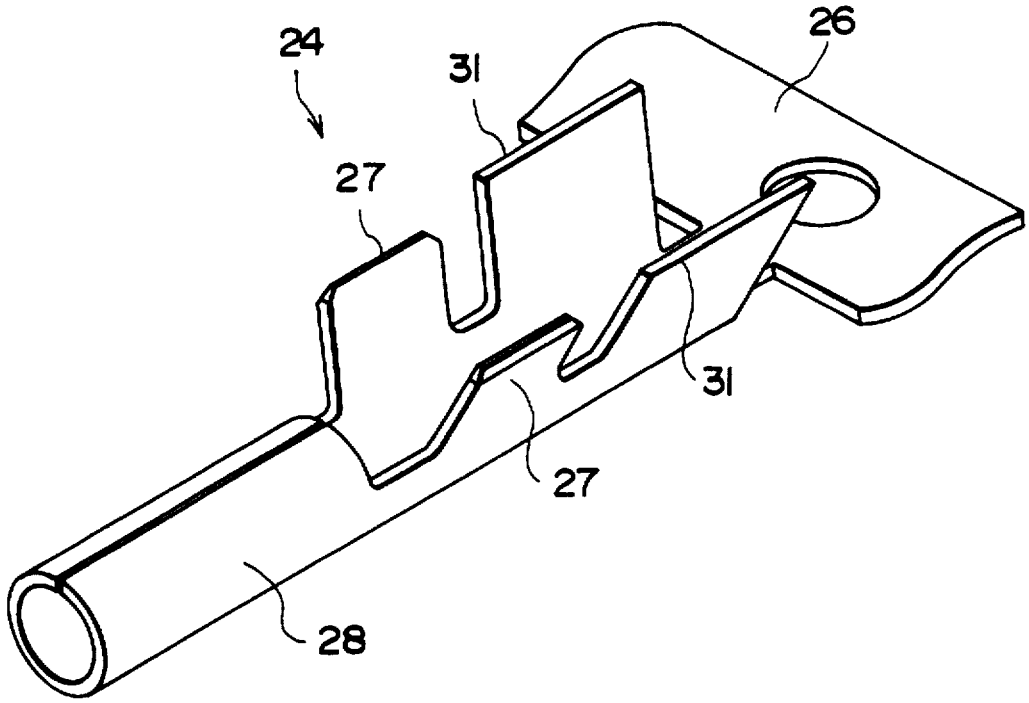
FIG. 7 is a perspective view of yet another lug terminal strip.

In still another lug terminal strip 24 shown in FIG. 6, the slit 32 is formed in plural numbers on the cylindrical portion 28 of the lug terminal strip 24 of FIG. 5. Further, FIG. 7 shows yet another lug terminal strip 24, in which no slit 32 is formed on the cylindrical portion 28 of the lug terminal strip 24 of FIG. 5. These alternatives may be selected properly as required.

As described in detail above, according to the present invention, the lug terminal strips are interposed between the end of the stator wire which is covered with the insulating tube and the fastening terminals. The lug terminal strips each include a pair of conductor pressing portions, a cylindrical portion formed on one side of the conductor pressing portions, and a pair of insulating film fixing portions formed on the other side of the conductor pressing portions so that the fastening terminal can be connected to the cylindrical portion by pressing the conductor pressing portions onto the stator winding and fixing the end of the wire from the insulating film fixing portions to the insulating tube covering the wire by pressure welding. For this reason, the insulating film fixing portions can be fixed to the insulating tube with pressure welding simultaneously with the pressing of the conductor pressing portions onto the stator winding wire, and this makes it possible to ease the effort required in making a connection between the end of the stator winding and the lug terminal strips, resulting in a remarkable improvement in the effort required to make a connection between the end of stator winding and the fastening terminals.

In particular, the lug terminal strips are manufactured with press molding, and this allows forming a series of terminals coupled with a serial terminal joint, thereby automating the connection process with the stator winding and the like.

Further, the conductor pressing portions (and the conductor soldering portions) can be soldered simultaneously by injecting the melted solder into the wire from the cylindrical portion after pressing the stator winding into the conductor pressing portions, and this makes it possible to remarkably improve the effort needed to connect the end of the stator winding with the lug terminal strips on the whole.

Furthermore, the cylindrical portion can be smoothly filled with melted solder through the slit or slits formed on the cylindrical portion, resulting in a further improvement in the connection between the end of the stator winding and the lug terminal strips.

What is claimed is:

1. An electric connection between electric elements within a container and a sealed terminal fixed to the container including lug terminal strips each being electrically connectable to a lead wire from the electric element which is covered with an insulating tube, and fastening terminals electrically connected through said lug terminal strips to the sealed terminal for supplying power to the electric elements, each said lug terminal strip comprising:

a pair of conductor pressing portions arranged on opposite sides of the lead wire in an area where the insulating tube has been removed to form an exposed wire end, said conductor pressing portions being crimped to said exposed wire end, a cylindrical portion formed on one side of said conductor pressing portions, said exposed wire end being inserted into said cylindrical portion and being electrically connected to said lug terminal strip by solder inserted therein, and which substantially fills and solidifies within, said cylindrical portion, said cylindrical portion receiving therearound and being connected to a fastening terminal, and a pair of insulating film fixing portions arranged on opposite sides of the lead wire in an area where the insulating tube remains, said pair of insulating film fixing portions being crimped to the insulating tube and being formed on the other side of said conductor pressing portions.

2. The electrical connection of claim 1, wherein at least one slit is formed on said cylindrical portion.

3. A lug terminal strip for connecting a lead wire of an electrical element to a fastening terminal, comprising:

a pair of conductor pressing portions arranged to be on opposite sides of the lead wire in an area where the insulating tube has been removed to form an exposed conductor end, said conductor pressing portions being adapted to be crimped to the lead wire exposed conductor end, a hollow cylindrical portion formed on one side of said conductor pressing portions, said hollow cylindrical portion being adapted to receive said lead wire exposed conductor end and to be filled with solder to solidify the hollow cylindrical portion, to electrically connect the lead wire to the terminal strip, said cylindrical portion being connectable to the fastening terminal, and a pair of insulating film fixing portions arranged on opposite sides of the lead wire in an area where the insulating tube remains, said insulating film fixing portions being adapted to be pressure welded to the insulating tube and being formed on the other side of said conductor pressing portions.

4. A terminal strip as in claim 3 wherein said cylindrical portion has at least one slit along its length.

* * * * *